US005623980A

United States Patent [19]

McMahon

[11] Patent Number: 5,623,980

[45] Date of Patent: Apr. 29, 1997

[54] HOLDER FOR RECEIVING AND RETAINING SMALL ARTICLES

[75] Inventor: Walter C. McMahon, Akron, Ohio

[73] Assignee: Quikey Manufacturing Company, Inc.

[21] Appl. No.: 499,572

[22] Filed: Jul. 7, 1995

[51] Int. Cl.[6] ..... A45C 1/02; A45C 11/32; A63B 57/00; B65D 33/24

[52] U.S. Cl. ..... 150/150; 150/900; 206/37; 206/38.1; 383/43

[58] Field of Search ..... 150/150, 900; 206/37, 0.82, 38.1; 383/43

[56] References Cited

U.S. PATENT DOCUMENTS

| | | | |
|---|---|---|---|
| 1,070,689 | 8/1913 | Irrgang et al. | 383/43 X |
| 1,138,882 | 5/1915 | Meier | 150/150 |
| 2,313,485 | 3/1943 | Stiller | 150/900 X |
| 2,322,920 | 6/1943 | Campbell | 150/900 X |
| 2,667,906 | 2/1954 | Stiller | 150/900 X |
| 2,823,723 | 2/1958 | Cohn | 150/900 X |
| 2,868,254 | 1/1959 | Saad | 150/150 X |
| 2,909,203 | 10/1959 | Reaves | 150/900 X |
| 3,016,940 | 1/1962 | Mullin | 150/900 X |
| 3,063,487 | 11/1962 | Mullin | 150/900 X |
| 3,110,335 | 11/1963 | Antonius | 383/43 |
| 3,119,429 | 1/1964 | Stiller et al. | 150/900 X |
| 3,160,186 | 12/1964 | Conley | 150/900 X |
| 3,176,743 | 4/1965 | Bundy | 383/43 |
| 3,353,579 | 11/1967 | Bechter et al. | 150/900 X |
| 4,907,694 | 3/1990 | Miller et al. | 150/900 X |
| 5,244,023 | 9/1993 | Spies | 150/900 X |
| 5,467,871 | 11/1995 | De Field | 206/38.1 X |
| 5,472,281 | 12/1995 | Phelps | 150/150 X |

FOREIGN PATENT DOCUMENTS

| | | | |
|---|---|---|---|
| 818951 | 8/1959 | United Kingdom | 150/150 |

OTHER PUBLICATIONS

A xerox copy of one side of a prior art coin holder.

A xerox copy of the top of the prior art coin holder showing the aperture.

*Primary Examiner*—Sue A. Weaver

*Attorney, Agent, or Firm*—Thompson Hine & Flory LLP

[57] ABSTRACT

A holder for receiving and retaining small objects comprises two substantially planar sheets, the sheets being joined to each other along a majority of their perimeters and separated along a minority of their perimeters to form a pocket between the sheets having a deformable aperture defined by the separated perimeters. The aperture and the pocket are sized to receive and hold the small objects. The holder further comprises a notch at each end of and contiguous with the aperture so that upon application of opposing pressure at the ends of the aperture, the holder is deformed to provide an opening for receiving or releasing the small objects.

11 Claims, 3 Drawing Sheets

HOLDER FOR RECEIVING AND RETAINING SMALL ARTICLES

BACKGROUND OF THE INVENTION

The present invention relates to a holder for holding small articles such as coins and the like.

Small plastic coin holders are presently commercially available, however these holders are of a generally circular or oval shape and the aperture for receiving the coins extends across the flat diameter of the holder in the case of the circular holder, and lengthwise across the flat surface of the oval holder. Such holders are not secure in that the aperture represents a relatively large opening which can be easily deformed to accidentally release the contents of the holder. Thus, it would be desirable to create a holder for coins and other small articles which has a maximum volume for holding the articles while having a minimum aperture for receiving the articles thereby improving the retentive characteristics of the holder with respect to its contents.

SUMMARY OF THE INVENTION

In accordance with the present invention a small holder for receiving and retaining small articles such as coins, keys, golf tees, golf ball markers, divot fixers, pencils, etc. are provided. The present holder has an aperture which can be readily deformed to receive the objects and yet is constructed so as to prevent the objects from becoming accidentally released from the holder.

The holder of the present invention is a seamless holder which comprises two substantially planar sheets formed from a compliant elastomeric material. The sheets are connected to each other along a majority of their perimeters and separated along a minority of their perimeters to form a pocket between the sheets having a deformable aperture defined by the separated perimeter. At each end of the aperture there is a notch which may be in the form of a small slit perpendicular to the aperture or a small gap or hole. Preferably, the notch is rectangular in shape with the longer side being perpendicular to the aperture and, most preferably, the notch is contiguous with the aperture so that, upon exertion of opposing pressure at the ends of the aperture, the holder is deformed and the aperture is symmetrically separated to provide an opening for receiving and releasing the small objects.

In one embodiment of the invention, the holder is of a size which allows it to be carried in a pocket of a pair of trousers and is useful as a coin holder.

In another embodiment of the invention, the holder is of a size which allows it to be used to store golf tees, ball markers, divot fixers, pencils and the like. In this embodiment, the holder, preferably, further comprises a strap so that it can be easily attached to a golf bag.

In a preferred aspect of the invention, the holder further comprises a plurality of protruding members molded along the aperture to prevent the objects contained within the pocket of the holder from being accidentally released. In a preferred configuration, the protrusions are formed in an alternating sequence along the lips of the aperture.

DETAILED DESCRIPTION OF THE INVENTION

Figure 1:
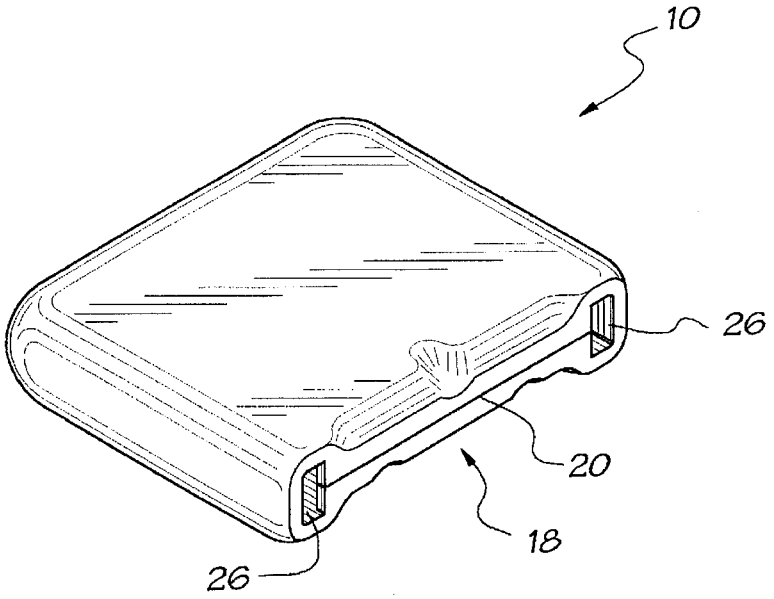
FIG. 1 is a perspective view of a first embodiment of the holder of the present invention.
Figure 2:
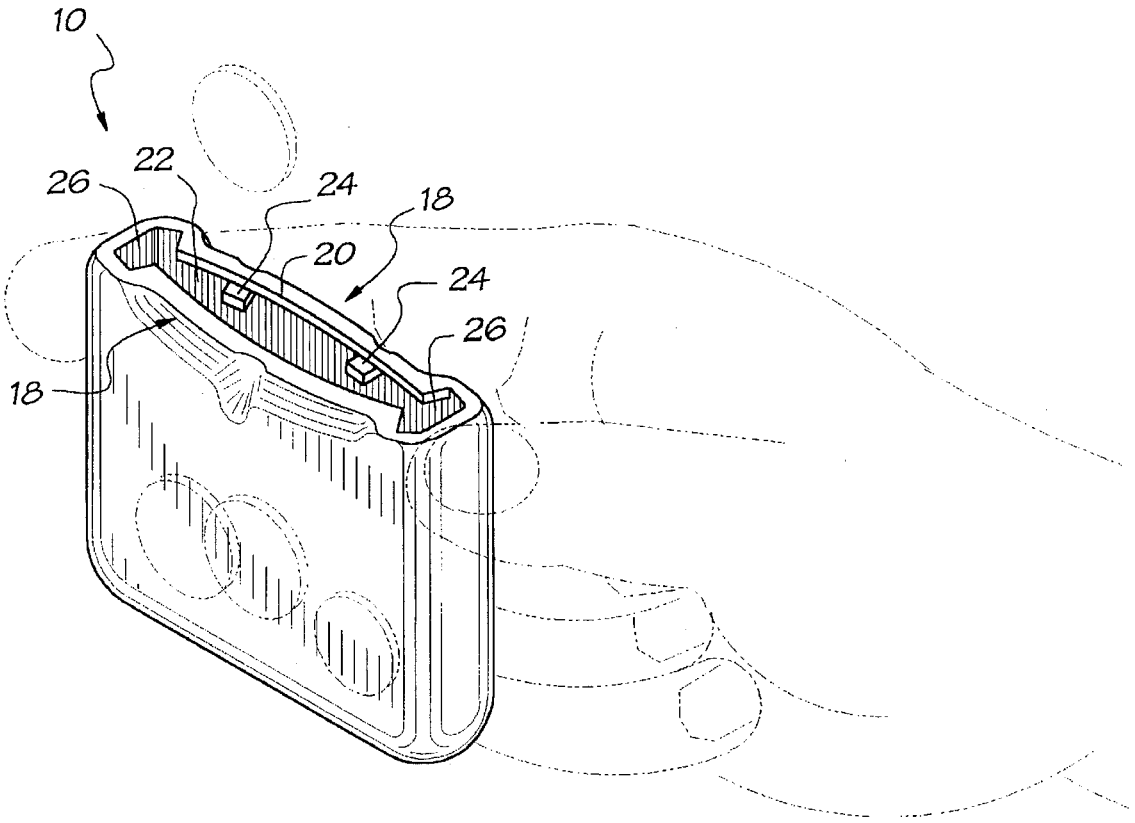
FIG. 2 is a perspective view of the first embodiment of the holder of the present invention showing the aperture in an open position.
Figure 3:
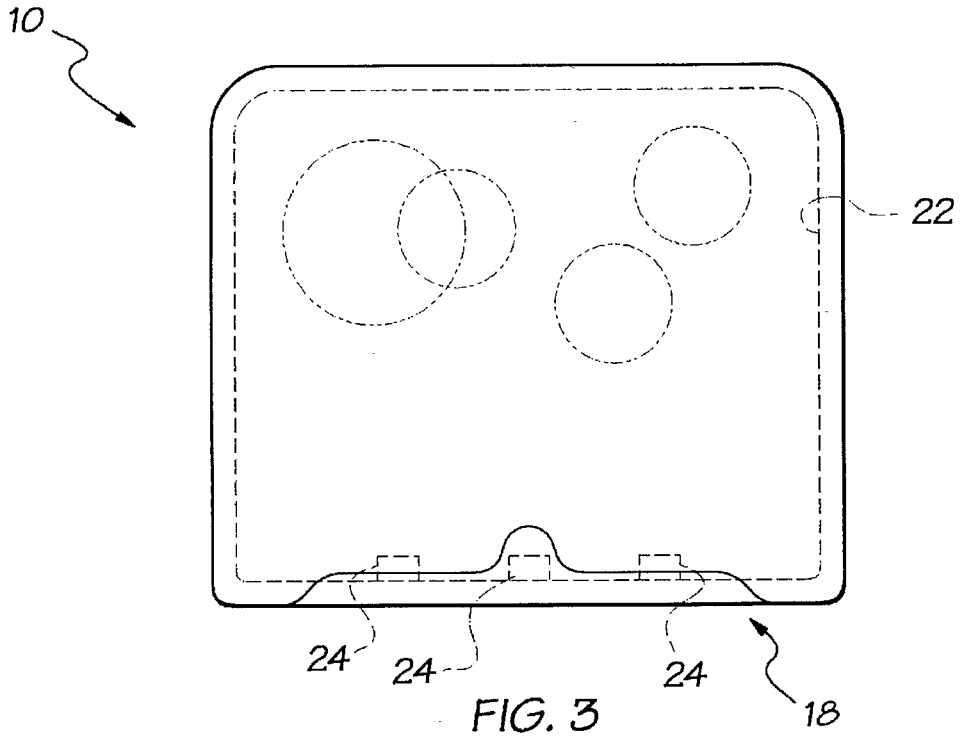
FIG. 3 is a side elevational view of the holder.
Figure 4:
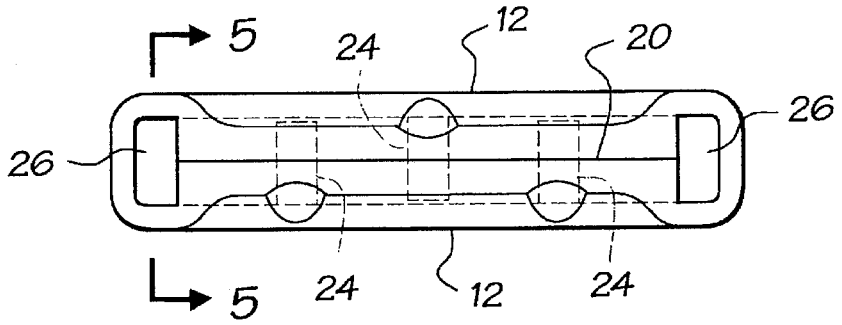
FIG. 4 is an end view of the holder.
Figure 5:
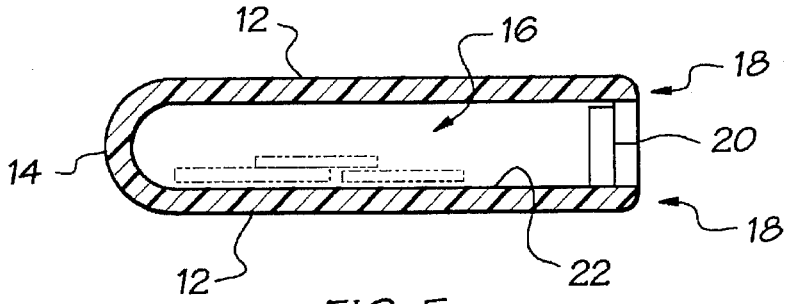
FIG. 5 is a cross-sectional view of the holder taken to along lines 5—5 of FIG. 4.

Referring generally to FIGS. 1–6, the holder 10 of the present invention is characterized in general as having two sheets 12 unitarily connected along a majority 14 of their perimeters and separated along a minority 18 of their perimeters to form a pocket 16 between the sheets having a deformable aperture 20 defined by the separated perimeters. It is preferable that the sheets 12 are substantially dimensionally identical in shape and seamless along the majority 14 of the perimeters.

The material used to form the holder 10 is a compliant elastomeric polymer or copolymer which is sufficiently pliable to allow deformation of the holder upon exertion of sufficient pressure by hand to cause a gap in the aperture 20, and is yet strong enough so that the holder 10 will not easily deteriorate on continued use. Furthermore, the material is smooth, yet tacky to the touch to allow one to easily handle the holder 10 without losing contact with it. Preferably, the material is a polyvinylchloride. Most preferably, the polyvinylchloride has a durometer measurement of hardness of about 75.

The holder 10 can be produced by dipping a mold conforming to the holder into a liquified PVC formulation and then removing the coated mold from the PVC formulation and curing the PVC holder. Once cured, the holder is removed from the mold. The aperture 20 can be formed in the mold or the holder 10 can be slit to form the holder after curing.

Figure 6:
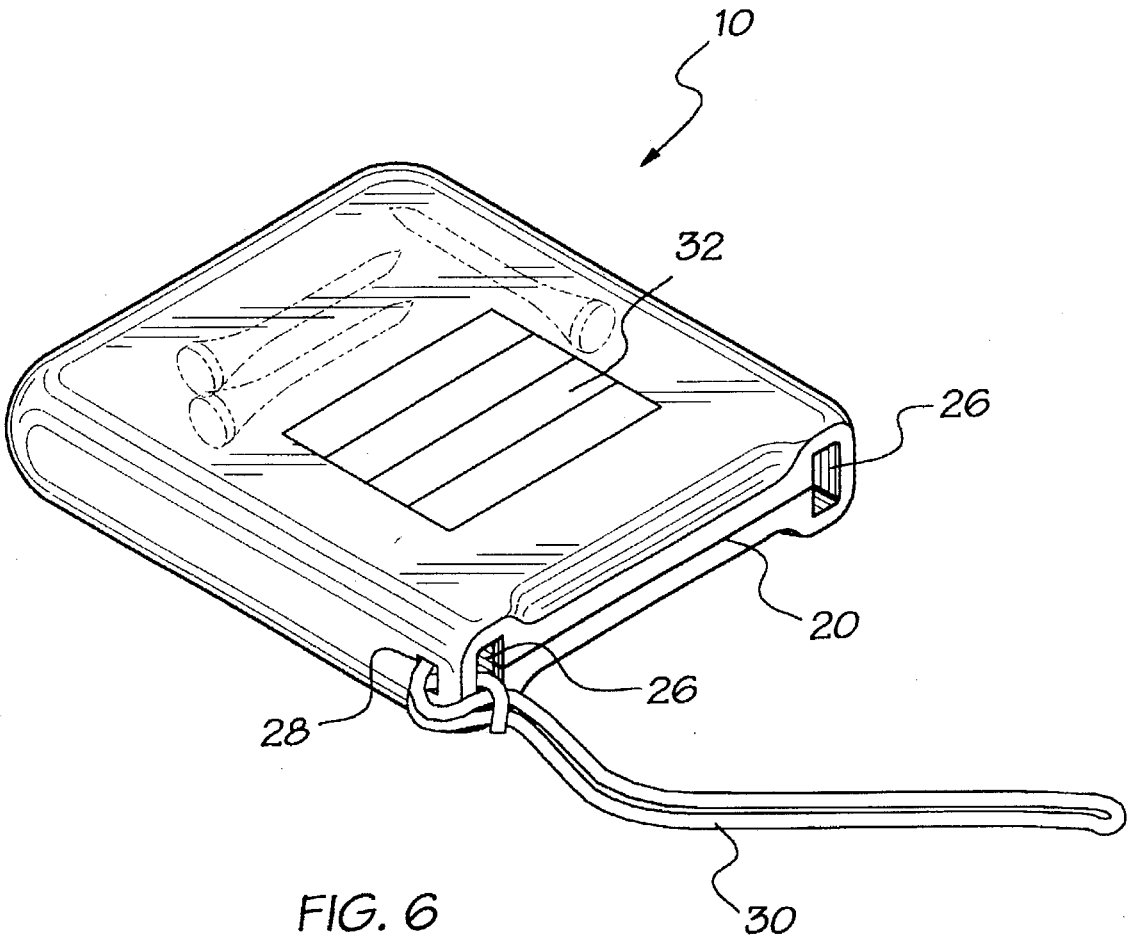
FIG. 6 is a perspective view of a second embodiment of the holder of the present invention.

The outer surface of the holder 10 may be conditioned by coating or other means which will allow the exterior surface of the holder 10 to be susceptible to markings, e.g., for means of identification, logos, symbols, designs, art work or messages as illustrated by 32 in FIG. 6. The markings may be made by printing or by hand-marking such as ink, paint, etc.

The interior surface 22 of the holder 10 may or may not be textured. This textured surface creates a low coefficient of friction which may or may not be desirable depending upon the use of the holder 10 and its contents.

In a preferred aspect of the invention, the holder 10 further comprises a plurality of protruding members 24 along the aperture 20. The protruding members 24 are preferably spaced apart and positioned alternately along opposite edges of the aperture 20 to prevent the aperture from prematurely becoming deformed such that the small objects are accidentally released. The protruding members 24 may be designed to form an interlocking connection with the opposite edge of the aperture It has generally been found, however, that the mere presence of the protruding members is sufficient without interlocking with the opposite side of the aperture 20.

The shape of the holder 10 is not particularly critical; however, it is preferable that the aperture lie linearly along the minority of the perimeter of the holder. The majority of the perimeter of the holder may have a generally square, rectangular, oval or circular shape.

At each end of the aperture 20, there is an exaggerated opening 26 which allows the aperture 20 to gap open upon the application of pressure. The openings 26 may be any configuration such as a generally rectangular or circular hole, or the opening 26 may be in the form of a slit generally perpendicular to the aperture 20.

In another embodiment of the present invention, the holder 10 is sized to accommodate articles which are slightly bulkier than coins, keys, etc. For example, the larger holder 10 is useful as a T-caddy for holding golf tees, golf ball markers, divot fixers, pencils, small pads, etc. In this embodiment, the holder 10 preferably contains a strap or cord 30 threaded through one of the openings 26 and through an additional orifice 28 to secure the strap or cord to the holder 10. The strap or cord from which the holder 10 is suspended can be formed from any material commonly used in such applications. For example, the strap or cord may be a metal chain, a natural or synthetic shoe lace or string, e.g., leather and the like. The holder 10 can then be easily attached to a person's belt or, preferably, to a golf bag where it can also serve as an identification tag.

Having described the invention in detail and by reference to the drawings, it will be apparent that modifications and variations are possible without departing from the scope of the invention as defined in the following claims.

What is claimed is:

1. A holder for receiving and retaining small objects comprising two substantially pliable planar sheets, said sheets being seamlessly joined to each other along a majority of their perimeters and separated along a minority of their perimeters to form a pocket between said sheets having a deformable linear aperture defined by said separated perimeters, said holder further comprising a plurality of protruding members interiorly positioned below said aperture and spaced apart alternately along opposite lower edges adjacent to said aperture, and a notch at each end of and contiguous with said aperture such that upon application of inwardly directed pressure on the upper perimeter of said holder at the ends of said aperture, said holder is deformed and said aperture opens to provide access to said pocket for receiving or releasing said objects.

2. The holder of claim 1 wherein said holder is molded from a compliant elastomeric material.

3. The holder of claim 2 wherein said compliant elastomeric material is a polyvinylchloride.

4. The holder of claim 1 wherein said notch is rectangular.

5. The holder of claim 4 wherein said notch includes a longer side and a shorter side and said longer side is perpendicular to said aperture.

6. The holder of claim 1 wherein at least one outer surface of said holder is conditioned such that said outer surface is susceptible to marking.

7. The holder of claim 6 wherein said surface conditioned by coating at least a portion of said surface with a coating susceptible to marking.

8. The holder of claim 6 wherein said outer surface is susceptible to ink.

9. The holder of claim 1 further comprising a strap, cord or chain.

10. The holder of claim 1 wherein said aperture is a slit.

11. The holder of claim 1 wherein said notch is a slit.

* * * * *